US007716889B2

(12) United States Patent
Pervan

(10) Patent No.: US 7,716,889 B2
(45) **Date of Patent: *May 18, 2010**

(54) FLOORING SYSTEMS AND METHODS FOR INSTALLATION

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 11/822,689

(22) Filed: Jul. 9, 2007

(65) Prior Publication Data

US 2008/0000180 A1 Jan. 3, 2008

Related U.S. Application Data

(63) Continuation of application No. 10/975,923, filed on Oct. 29, 2004, which is a continuation of application No. PCT/SE2004/000327, filed on Mar. 8, 2004.

(60) Provisional application No. 60/515,661, filed on Oct. 31, 2003.

(30) Foreign Application Priority Data

Mar. 6, 2003 (SE) ..... 0300626
Oct. 29, 2003 (SE) ..... 0302865

(51) Int. Cl.
*E04F 13/08* (2006.01)

(52) U.S. Cl. ..... 52/392; 52/589.1; 52/591.4; 52/592.1

(58) Field of Classification Search ..... 52/589.1, 52/591.1, 591.4, 591.5, 592.1, 403.1, 747.1
See application file for complete search history.

(56) References Cited

U.S. PATENT DOCUMENTS

| | | | | |
|---|---|---|---|---|
| 1,787,027 | A | 12/1930 | Wasleff | |
| 2,430,200 | A | 11/1947 | Wilson | |
| 2,740,167 | A | 4/1956 | Rowley | |
| 3,377,931 | A | 4/1968 | Hilton | |
| 4,426,820 | A | 1/1984 | Terbrack et al. | |
| 5,295,341 | A | 3/1994 | Kajiwara | |
| 6,006,486 | A * | 12/1999 | Moriau et al. | 52/589.1 |
| 6,023,907 | A | 2/2000 | Pervan | |
| 7,127,860 | B2 * | 10/2006 | Pervan et al. | 52/592.1 |
| 2002/0178674 | A1 | 12/2002 | Pervan | |
| 2002/0178682 | A1 | 12/2002 | Pervan | |

(Continued)

FOREIGN PATENT DOCUMENTS

| | | |
|---|---|---|
| CA | 991373 | 6/1976 |

(Continued)

OTHER PUBLICATIONS

Official Action issued in co-pending U.S. Appl. No. 10/975,923 on Apr. 10, 2009.

(Continued)

*Primary Examiner*—Basil Katcheves
(74) *Attorney, Agent, or Firm*—Buchanan Ingersoll & Rooney PC

(57) ABSTRACT

Floorboards for mechanical joining of floors in a herringbone pattern and in parallel rows with horizontal connectors which on the short sides have cooperating locking surfaces which are designed differently from the cooperating locking surfaces on the long sides.

17 Claims, 14 Drawing Sheets

U.S. PATENT DOCUMENTS

| | | | |
|---|---|---|---|
| 2003/0101674 | A1 | 6/2003 | Pervan |
| 2003/0221387 | A1 | 12/2003 | Shah |
| 2004/0035079 | A1 | 2/2004 | Evjen |
| 2004/0045254 | A1 | 3/2004 | Van der Heijden |
| 2004/0177584 | A1 | 9/2004 | Pervan |
| 2005/0108970 | A1 | 5/2005 | Liu |
| 2005/0138881 | A1 | 6/2005 | Pervan |
| 2005/0160694 | A1 | 7/2005 | Pervan |
| 2005/0210810 | A1 | 9/2005 | Pervan |
| 2006/0032168 | A1 | 2/2006 | Thiers et al. |
| 2006/0070333 | A1 | 4/2006 | Pervan |
| 2006/0260254 | A1 | 11/2006 | Pervan |
| 2006/0283127 | A1 | 12/2006 | Pervan |
| 2008/0000187 | A1 | 1/2008 | Pervan |
| 2008/0028707 | A1 | 2/2008 | Pervan |
| 2008/0041008 | A1 | 2/2008 | Pervan |
| 2008/0110125 | A1 | 5/2008 | Pervan |
| 2008/0216434 | A1 | 9/2008 | Pervan |
| 2008/0216920 | A1 | 9/2008 | Pervan |
| 2009/0151291 | A1 | 6/2009 | Pervan |

FOREIGN PATENT DOCUMENTS

| | | | |
|---|---|---|---|
| DE | 2 159 042 | | 6/1973 |
| GB | 812671 | A | 4/1959 |
| JP | 10-219975 | A | 8/1998 |
| SE | 450 141 | B | 6/1987 |
| SE | 506254 | C2 | 11/1997 |
| WO | WO 84/02155 | A1 | 6/1984 |
| WO | WO 94/26999 | A1 | 11/1994 |
| WO | WO 98/38401 | A1 | 9/1998 |
| WO | WO 99/66152 | A1 | 12/1999 |
| WO | WO 01/66877 | A1 | 9/2001 |
| WO | WO 02/055810 | A1 | 7/2002 |
| WO | WO 03/025307 | A1 | 3/2003 |
| WO | WO 03/089736 | A1 | 10/2003 |

OTHER PUBLICATIONS

Official Action issued in co-pending U.S. Appl. No. 10/975,923 on Jan. 29, 2008.
Official Action issued in co-pending U.S. Appl. No. 10/975,923 on Jul. 25, 2007.
Official Action issued in co-pending U.S. Appl. No. 10/975,923 on Oct. 11, 2006.
Official Action issued in co-pending U.S. Appl. No. 10/975,923 on Jun. 8, 2006.
Official Action issued in co-pending U.S. Appl. No. 10/808,455 on Mar. 20, 2009.
Official Action issued in co-pending U.S. Appl. No. 10/808,455 on Jun. 3, 2008.
Official Action issued in co-pending U.S. Appl. No. 10/808,455 on Nov. 15, 2007.
Official Action issued in co-pending U.S. Appl. No. 10/808,455 on May 29, 2007.
Official Action issued in co-pending U.S. Appl. No. 10/808,455 on Oct. 23, 2006.
Official Action issued in co-pending U.S. Appl. No. 10/808,455 on Jul. 11, 2006.
International Search Report (Form PCT/ISA/210) issued in related PCT application PCT/SE2004/000327.
International Preliminary Report on Patentability (Form PCT/IB/373) issued in related PCT application PCT/SE2004/000327.
Written Opinion of the International Searching Authority (Form PCT/ISA/237) issued in related PCT application PCT/SE2004/000327.

* cited by examiner

4a
R1
R2
4b
A 2
A4
5b
4b
4a
A 1
5a
A 3
A
5b
4b

R1
4a
R2
5a
A 2
A4
4a
A 1
5b
4b
A 3
A
5b
4b

R1
4a
5a
R2
A 2
A4
R3
4a
A 1
5b
4b
5a
A 3
A5
5b
4b
5b

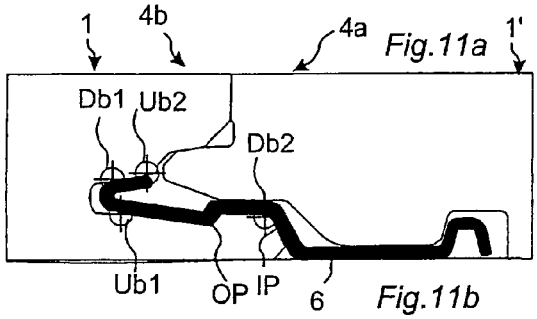
Fig.11a
Fig.11b
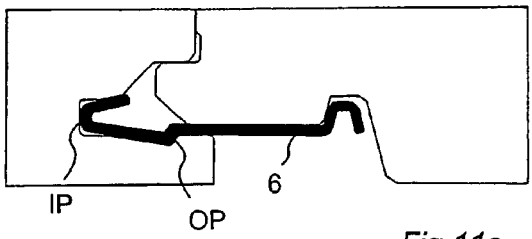
Fig.11c
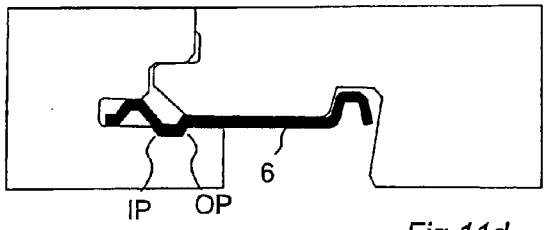
Fig.11d
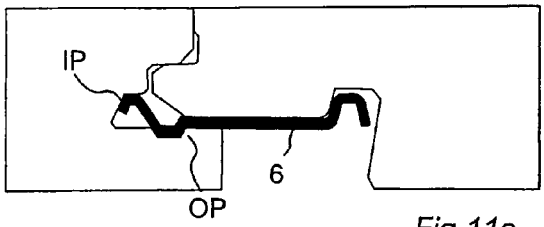
Fig.11e
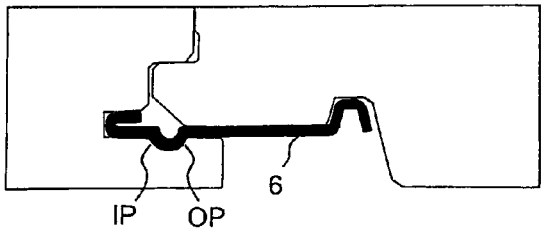
Fig.11f
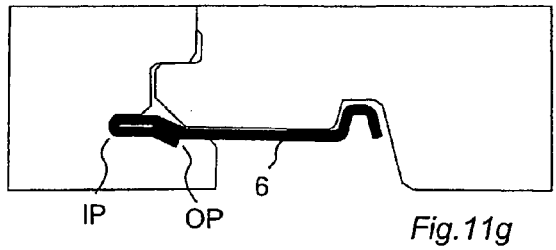
Fig.11g
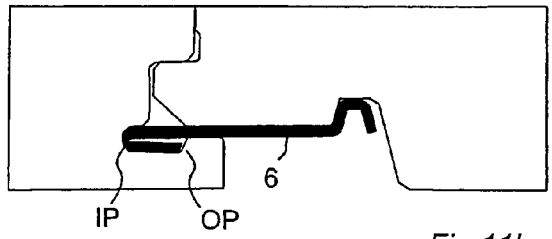
Fig.11h
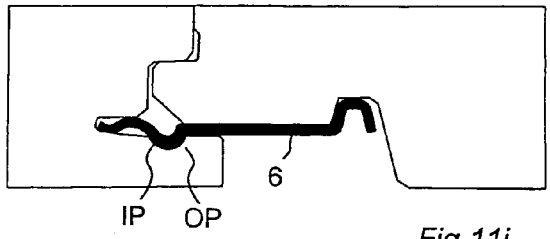
Fig.11i
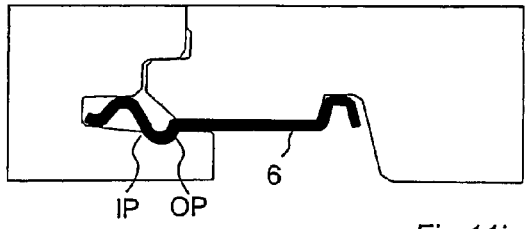
Fig.11j
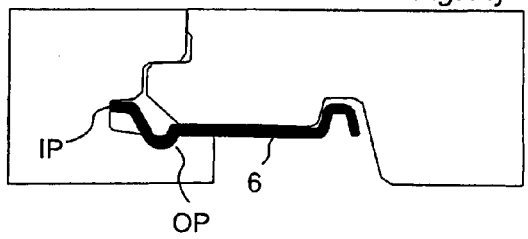

FLOORING SYSTEMS AND METHODS FOR INSTALLATION

CROSS-REFERENCE TO RELATED APPLICATIONS

The present application is a continuation of application Ser. No. 10/975,923, filed on Oct. 29, 2004, which claims the benefit of U.S. Provisional Application No. 60/515,661, filed on Oct. 31, 2004. Application Ser. No. 10/975,923 is a continuation of PCT/SE2004/000327, filed on Mar. 8, 2004, and claims priority of SE 0300626-9 and SE 0302865-1, filed in Sweden on Mar. 6, 2003 and Oct. 29, 2003, respectively. The subject matter of U.S. Patent Application No. 60/515,661, PCT/SE2004/000327, SE 0300626-9, and SE 0302865-1 are hereby incorporated herein by reference.

TECHNICAL FIELD

The invention relates generally to the technical field of locking systems for floorboards. The invention concerns on the one hand a locking system for floorboards which can be joined mechanically in different patterns and, on the other hand, floorboards provided with such a locking system, as well as methods of installation. More specifically, the invention relates above all to locking systems which enable laying of mainly floating floors in advanced patterns.

FIELD OF APPLICATION

The present invention is particularly suited for use in floating wooden floors and laminate floors, such as massive wooden floors, parquet floors, laminate floors with a surface layer of high-pressure laminate or direct laminate. Laminate floors have a surface consisting of melamine impregnated paper which is compressed under pressure and heat.

The following description of prior-art technique, problems of known systems as well as the objects and features of the invention will therefore as non-limiting examples be aimed mainly at this field of application. However, it should be emphasized that the invention can be used in any floorboards which are intended to be joined in different patterns by means of a mechanical joint system. The invention may thus also be applicable to floors with a surface of plastic, linoleum, cork, needle felt, varnished fiberboard surface and the like.

DEFINITION OF SOME TERMS

In the following text, the visible surface of the installed floorboard is called "front side", while the opposite side of the floorboard facing the subfloor is called "rear side". "Horizontal plane" relates to a plane which is extended parallel to the outer part of the surface layer. Directly adjoining upper parts of two neighboring joint edges of two joined floorboards together define a "vertical plane" perpendicular to the horizontal plane.

The outer parts of the floorboard at the edge of the floorboard between the front side and the rear side are called "joint edge". As a rule, the joint edge has several "joint surfaces" which can be vertical, horizontal, angled, rounded, beveled etc. These joint surfaces exist on different materials, for instance laminate, fiberboard, wood, plastic, metal (in particular aluminum) or sealing materials. "Joint edge portion" relates to the joint edge of the floorboard and a part of the floorboard portions close to the joint edge. By "joint", "joint system" or "locking system" are meant cooperating connecting means which interconnect the floorboards vertically and/or horizontally. By "mechanical joint system" is meant that joining can take place without glue. Mechanical joint systems can in many cases also be joined by glue. By "vertical locking" is meant locking parallel to the vertical plane and by "horizontal locking" is meant locking parallel to the horizontal plane. By "groove side" is meant the side of the floorboard in which part of the horizontal locking consists of a locking groove whose opening faces to the rear side. By "locking side" is meant the side of the floorboard in which part of the horizontal locking consists of a locking element which cooperates with the locking groove. By "locking angle" is meant the angle of the locking surfaces relative to the horizontal plane. In the cases where the locking surfaces are curved, the locking angle is the tangent to the curve with the highest angle.

BACKGROUND OF THE INVENTION

Traditional laminate and parquet floors are usually installed floating, i.e., without gluing, on an existing subfloor which does not have to be perfectly smooth or flat. Floating floors of this kind are usually joined by means of glued tongue and groove joints (i.e., joints with a tongue on one floorboard and a tongue groove on an adjoining floorboard) on long side and short side. In laying, the boards are brought together horizontally, a projecting tongue along the joint edge of one board being inserted into a tongue groove along the joint edge of an adjoining board. The same method is used on long side as well as on short side, and the boards are usually laid in parallel rows long side against long side and short side against short side.

In addition to such traditional floors which are joined by means of glued tongue/tongue groove joints, floorboards have been developed in recent years, which do not require the use of glue but which are instead joined mechanically by means of so-called mechanical joint systems. These systems comprise locking means which lock the boards horizontally and vertically. The mechanical joint systems can be formed by machining the core of the board. Alternatively, parts of the locking system can be made of a separate material which is integrated with the floorboard, i.e., already joined with the floorboard in connection with the manufacture thereof at the factory. The floorboards are joined, i.e., interconnected or locked together, by various combinations of angling, snapping-in and insertion along the joint edge in the locked position.

The principal advantages of floating floors with mechanical joint systems are that they can be laid quickly and easily by different combinations of inward angling and snapping-in. They can also be easily taken up again and be reused in some other place.

PRIOR-ART TECHNIQUE AND PROBLEMS THEREOF

All currently existing mechanical joint systems and also floors intended to be joined by gluing have vertical locking means which lock the floorboards across the surface plane of the boards. The vertical locking means consist of a tongue which enters a groove in an adjoining floorboard. The boards thus cannot be joined groove against groove or tongue against tongue. Also the horizontal locking system as a rule consists of a locking element on one side which cooperates with a locking groove in the other side. Thus, the boards cannot be joined locking element against locking element or locking groove against locking groove. This means that the laying is in practice restricted to parallel rows. Using this technique, it is thus not possible to lay traditional parquet patterns where the boards are joined long side against short side in a "herringbone pattern" or in different forms of diamond patterns. It is known that floorboards can be made in formats which correspond to traditional parquet blocks and in A and B designs with mirror-inverted joint systems and that such floorboards can be joined mechanically in a herringbone pattern (WO 03/025307 owner Välinge Aluminium AB/Välinge Innovation AB) by various combinations of angling and snapping-in. Such floorboards can also, if the joint systems are designed in a suitable way, be joined in parallel rows. This is advantageous since a plurality of patterns can then be provided with the same type of floorboards.

An installation of floorboards, for example by angling of long sides and snapping of short sides, is time consuming especially when the floor consists of many small floorboards.

It would be an advantage if floorboards could be installed quickly and easily, especially in herringbone pattern but also in other patterns, with only an angling of the long sides. Such a simple laying method should be combined with joint systems having sufficient horizontal strength in the short sides when installed in parallel rows especially when the floorboards are narrow, for instance 60-120 mm, and when small short side must be able to handle the same high shrinking forces as larger panels.

Narrow and small floorboards usually also take longer to be installed in parallel rows than traditional floorboards. It would be advantageous if the installation time could be reduced by simpler joining and less movement in connection with laying of the different parallel rows. There is thus a great need to improve the locking system and the laying methods when installing especially narrow floorboards which are laid by merely inward angling in a herringbone pattern as well as in parallel rows.

SUMMARY

The present invention relates to joint systems, floorboards, floors and methods of installation which make it possible to install floating floors more quickly, more easily and with greater strength than is known today in advanced patterns long side against short side and in parallel rows by merely an angular motion towards the subfloor. Also disassembly can take place quickly and easily by a reverse method.

The terms long side and short side are used to facilitate understanding. The boards can according to the invention also be square or alternately square and rectangular and optionally also exhibit different patterns or other decorative features in different directions.

A first object of the present invention is to provide floorboards, joint systems, methods of installation, and methods of disassembly, which make it possible to provide a floor which consists of rectangular floorboards joined mechanically in advanced patterns long side against short side and which can be disassembled and reused. The floorboards and the locking system are characterized in that joining and disassembly can take place merely by inward angling along the long sides of the boards. The angling method is considerably simpler than snapping-in, and a locking system which is locked by inward angling can be made stronger than a locking system which is locked by snapping-in. A special object is to provide such floors with a surface layer of high-pressure laminate or direct laminate.

A second object of the present invention is to provide rectangular floorboards and locking systems which satisfy the above requirements and which are characterized in that the horizontal locking systems of the long side and the short side consist of a tongue with a locking element which cooperates with a tongue groove and an undercut groove. Such locking systems can be made in one piece with the floorboard and with a geometry that reduces the waste of material.

A third object is to provide floorboards and locking systems in which the short sides have horizontal locking means which differ from the locking means of the long sides. Preferably, the short sides have horizontal locking systems with locking surfaces having a higher locking angle than the long sides. Joining of short side against short side in parallel rows can then take place with great strength.

A fourth object is to provide floorboards and locking systems which on the long sides and short sides have horizontal locking systems with locking surfaces which are essentially perpendicular to the horizontal plane and which allow great strength when joining long side against long side and short side against short side.

A fifth object is to provide different joint systems which are suitable for use in the above floorboards and which partly consist of separate materials which are joined to the floorboard.

A sixth object is to provide laying methods which reduce the time of laying especially in the cases where small and narrow floorboards are laid in parallel rows.

It should be particularly emphasized that the combinations of joint systems that exist in this description are only examples of suitable embodiments. All joint systems can be used separately in long sides and/or short sides as well as in different combinations on long sides and short sides. The joint systems having horizontal and vertical locking means can be joined by angling and/or snapping-in. The geometries of the joint systems and the active horizontal and vertical locking means can be made by machining the edges of the floorboard or by separate materials being formed or alternatively machined before or after joining to the joint edge portion of the floorboard.

This object is achieved wholly or partly by flooring systems and methods according to the appended independent claims. Embodiments are set forth in the dependent claims and in the following description and drawings.

According to a first aspect, the present invention comprises a flooring system comprising rectangular floorboards which are mechanically lockable. In the flooring system, each individual floorboard along its long sides has a pair of opposing connecting means for locking together said floorboard with similar, adjoining floorboards both vertically and horizontally and along its short sides has a pair of opposing connecting means. Furthermore, the connecting means of the floorboards are designed so as to allow locking-together of the long sides by angling along an upper joint edge. The floorings system is distinguished in that said pair of opposing connecting means of said short sides are adapted for locking the floorboards only horizontally, the system comprises two different types of floorboard, and the connecting means of one type of floorboard along one pair of opposite edge portions being arranged in a mirror-inverted manner relative to the corresponding connecting means along the same pair of opposite edge portions of the other type of floorboard.

In one embodiment, the connecting means of the floorboards are designed so as to allow locking-together of the long sides by angling along the upper joint edge and of the short sides by a substantially vertical motion, and wherein a first short side is lockable to a first long side vertically and horizontally, and a second short side is lockable to a second long side only horizontally by a substantially vertical motion, and the horizontal connecting means on the short sides having cooperating locking surfaces which are formed differently from the cooperating locking surfaces of the horizontal connecting means of the long sides.

By being designed differently is meant, for instance, differences with respect to:

angle, shape, extent of the contact surfaces and their vertical position in the joint system, type of material, combinations of materials, impregnating with property changing chemicals, designing of the parts of the joint system that affect the strength, compression and the relative position between the locking surfaces.

As an example of item c) above, it may be mentioned that different designs of the locking element, especially with respect to its horizontal extent, may have a considerable effect on the strength of the locking surface when subjected to tension load. Different plays or the non-existence of play between the locking surfaces may give the joint system different properties.

According to a second aspect, the present invention provides methods for laying a floor with two types of floorboards A and B which have mirror-inverted joint systems.

In one embodiment, laying takes place in a herringbone pattern by locking together two long sides of at least two floorboards of the first type of floorboard by angling towards two similar floorboards of the same type, and locking together another floorboard of the second type of floorboard by inward angling towards a similar floorboard of the same type.

According to another embodiment, laying takes place in parallel rows by angling in such a manner that a first B board in a new row is joined to the last laid A board in a preceding row.

There is also provided a flooring system comprising rectangular floorboards with long sides which have pairs of opposing connecting means which at least allow locking-together both horizontally and vertically by inward angling. This flooring system is distinguished in that the system comprises floorboards with a surface layer of laminate, said floorboards being joined in a herringbone pattern, and that joining and disconnecting is achievable by an angular motion.

Finally, there is provided a flooring system, which comprises rectangular floorboards joined in a herringbone pattern, with a surface layer of high pressure laminate or direct laminate, in which system the individual floorboards along their long sides have pairs of opposing mechanical connecting means for locking together similar, adjoining floorboards both vertically and horizontally by inward angling. In this embodiment, the short sides have merely horizontal locking means. Since the floorboards are narrow and the short sides are held together by the long sides, this is sufficient when the boards are installed in a herringbone pattern.

BRIEF DESCRIPTION OF THE DRAWINGS

FIGS. 11*a*-11*j* show joint systems according to the invention.

DESCRIPTION OF EMBODIMENTS

Figure 1A:
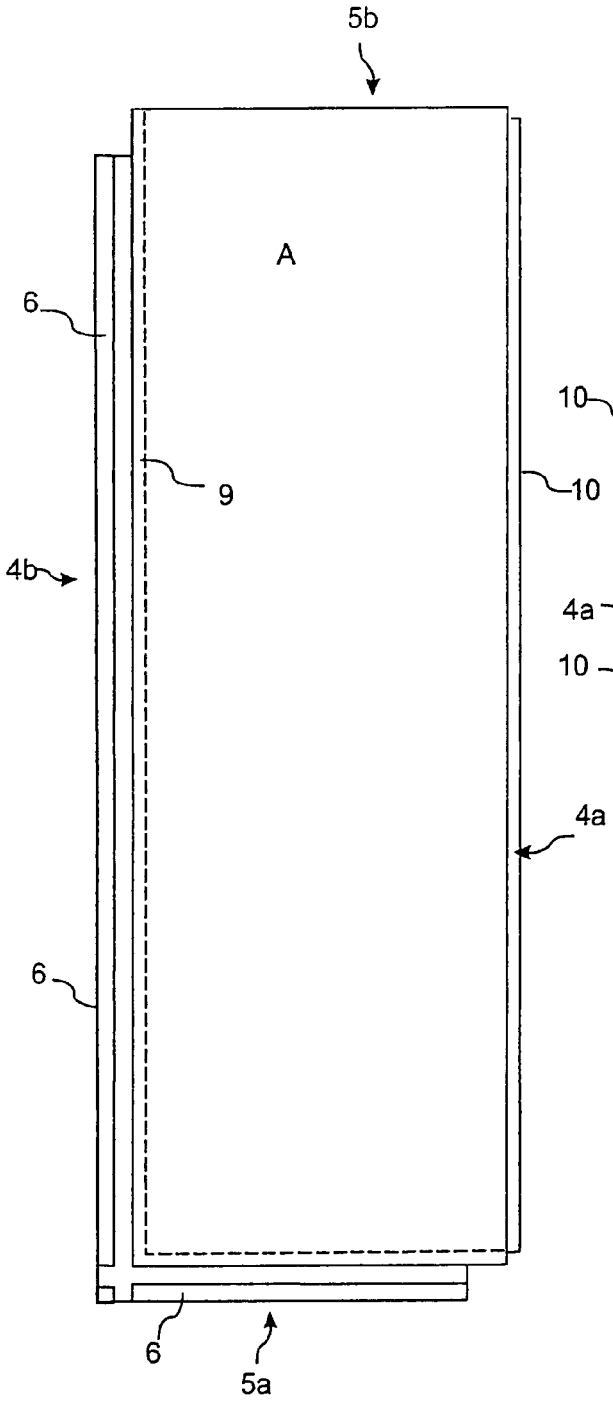
FIGS. 1*a-b* show floorboards according to the invention.
Figure 1B:
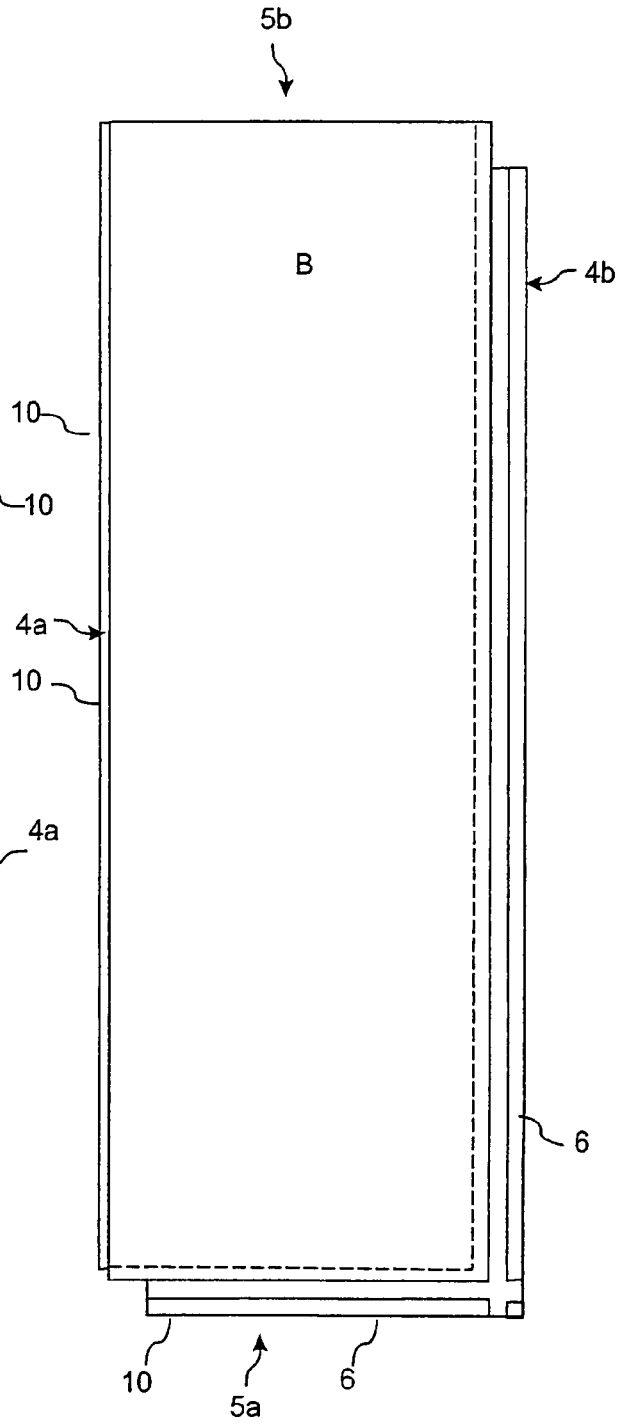

FIGS. 1*a-b* illustrate floorboards which are of a first type A and a second type B according to the invention and whose long sides 4*a* and 4*b* in this embodiment have a length which is 3 times the length of the short sides 5*a*, 5*b*. The long sides 4*a*, 4*b* of the floorboards have vertical and horizontal connecting means, and the short sides 5*a*, 5*b* of the floorboards have horizontal connecting means. In this embodiment, the two types are identical except that the location of the locking means is mirror-inverted. The locking means allow joining of long side 4*a* to long side 4*b* by at least inward angling and long side 4*a* to short side 5*a* by inward angling, and also short side 5*b* to long side 4*b* by a vertical motion. Joining of both long sides 4*a*, 4*b* and short sides 5*a*, 5*b* in a herringbone pattern can in this embodiment take place merely by an angular motion along the long sides 4*a*, 4*b*. The long sides 4*a*, 4*b* of the floorboards have connecting means which in this embodiment consist of a strip 6, a groove 9 and a tongue 10. The short sides 5*a* also have a strip 6 and a tongue groove 9 whereas the short sides 5*b* have no tongue 10. There may be a plurality of variants. The two types of floorboards need not be of the same format and the locking means can also have different shapes, provided that as stated above they can be joined long side against short side. The connecting means can be made of the same material, or of different materials, or be made of the same material but with different material properties. For instance, the connecting means can be made of plastic or metal. They can also be made of the same material as the floorboard, but be subjected to a treatment modifying their properties, such as impregnation or the like.

Figure 2A:
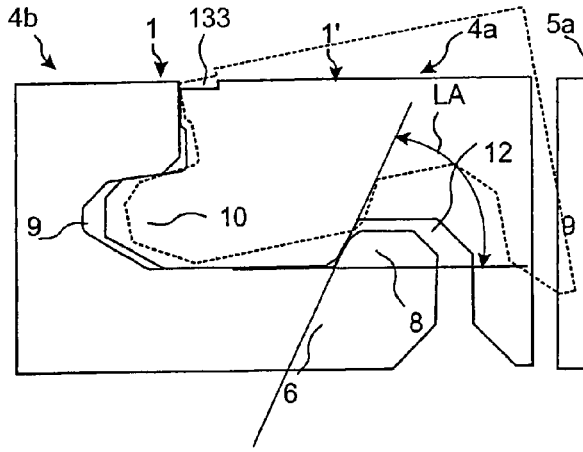
FIGS. 2*a*-2*f* show joint systems on long side and short side.
Figure 2B:
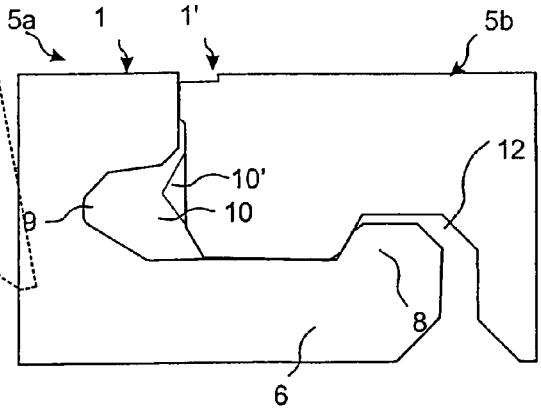
Figure 2C:
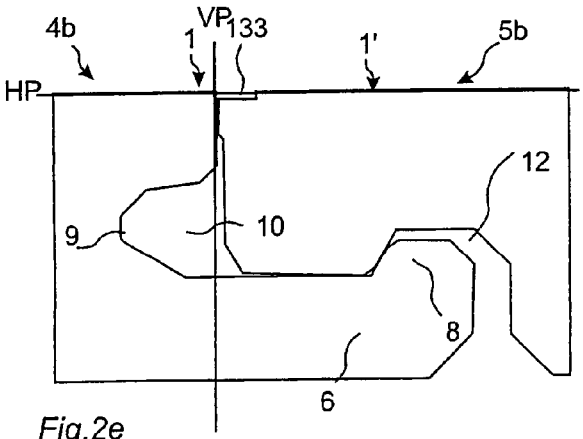

FIGS. 2*a*-2*e* show the connecting means of two boards 1, 1' which are joined to each other. FIG. 2*a* shows long sides 4*a* and 4*b*. The vertical locking consists of a groove 9 which cooperates with a tongue 10. The horizontal locking consists of a strip 6 with a locking element 8 which cooperates with a locking groove 12. This locking system can be joined by inward angling along upper joint edges. This is indicated by the dashed part in FIGS. 2*a* and 2*b*. In FIG. 2*c* HP is the horizontal plane and VP the vertical plane. The locking element 8 and the locking groove 12 have cooperating locking surfaces which in FIG. 2*a* have a locking angle LA of about 60 degrees. The floorboard 1' has in the upper joint edge a decorative groove 133.

Figure 2D:
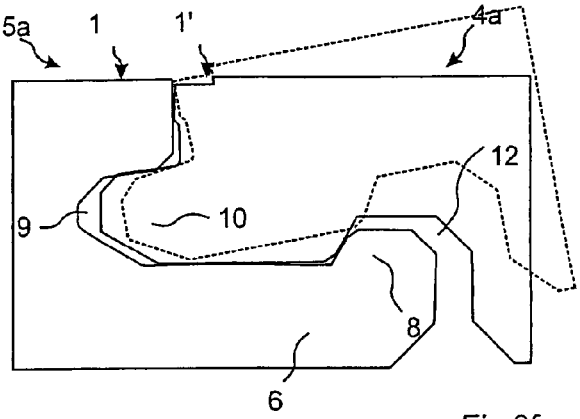
Figure 2E:
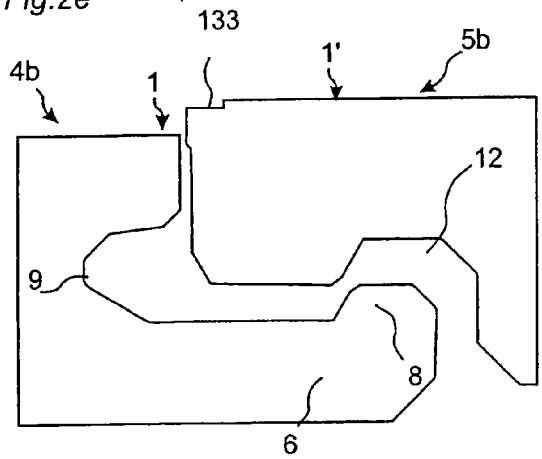
Figure 2F:
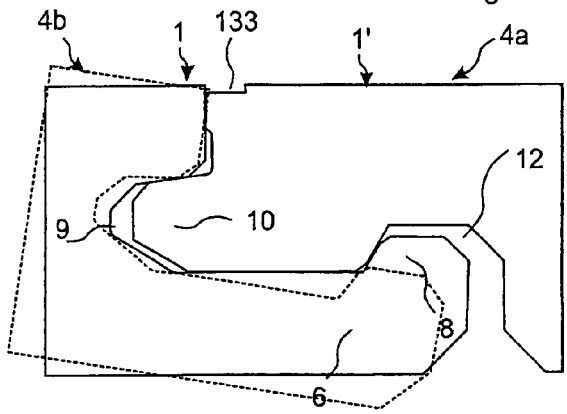

FIG. 2*b* shows the connecting means on the short side. They consist of a strip 6 with a locking element 8 which cooperates with a locking groove 10 and provides horizontal locking of the floorboards 1, 1'. The short side 5*a* has a groove 9 which is adapted to cooperate with the tongue 10 of the long side 4*a* when long sides and short sides are locked to each other. However, the short side 5*b* has no tongue 10. FIGS. 2*c*, 2*e* show how the short sides 5*b* is locked to the long side 4*b* by a vertical motion. The joint system preferred in FIG. 2*e* can only be joined vertically by the short side 5*b*, called the groove side, being placed on a long side or short side that has a protruding strip 6, called the locking side. In this embodiment, locking cannot take place by the locking side being placed on the groove side. FIG. 2*d* shows how the short side 5*a* can be locked to the long side 4*a* vertically and horizontally using a joint system that allows inward angling. FIG. 2*c* shows that it may be an advantage if there is a play between the locking groove 12 and a locking surface 14 on the locking element 8. One preferred embodiment is characterized by the fact that when the panels 5*b* and 4*b* are pressed together, they may occupy a position with a play of for example 0.01-0.1 mm. Such a play will eliminate pretension, even in high humidity, and the panel 5*b* will not be forced upwards, as could be the case when the panels are connected with pretension and vertical displacement is not prevented by e.g. a tongue. The play could be combined with a decorative groove 133, which may be painted or impregnated with a color. Such a decorative groove 133 may contribute to make the play invisible even if the play is rather large, for example 0.1-0.2 mm.

FIGS. 3*a*-3*e* show installation of a floor in a herringbone pattern which can be provided by merely inward angling. The floorboards can also be disengaged from each other in reverse order by upward angling.

Figure 3A:
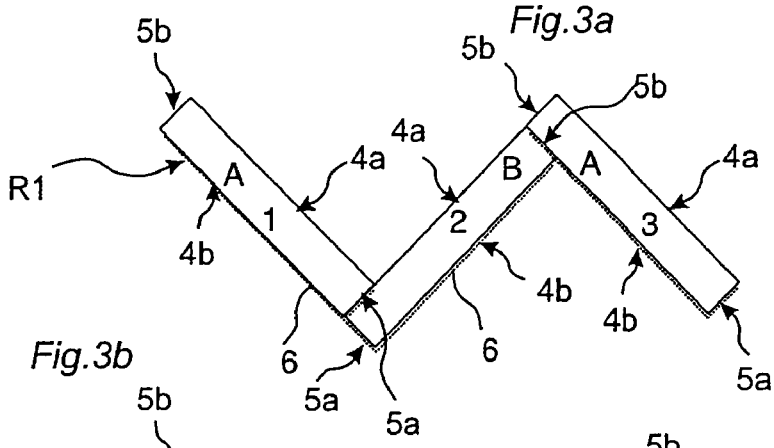
FIGS. 3*a*-3*d* show joining in a herringbone pattern.
Figure 3B:
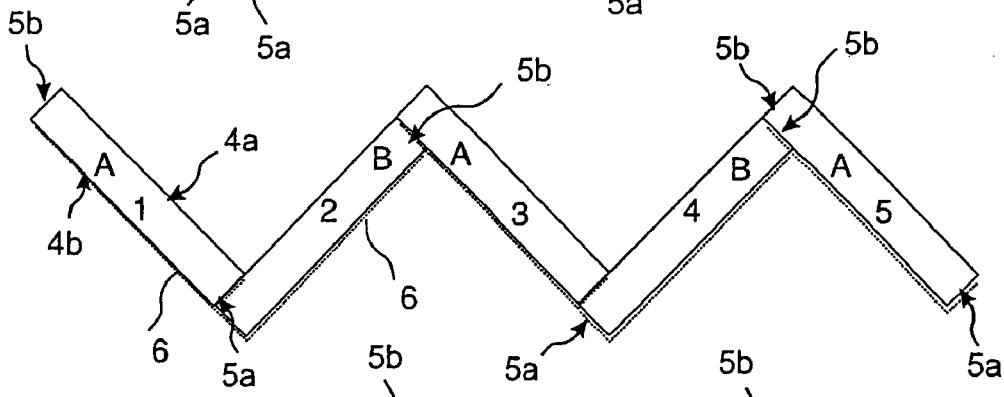

FIG. 3*a* shows how a type B floorboard is joined to a type A floorboard by angling long side 4*a* against short side 5*a*. Since the floorboard B 2 has no tongue on the short side 5*b*, it can be angled down towards the floorboard A 3. The numerals 1-3 indicate a suitable order of installation. The first row R1, seen transversely of the laying direction ID, can be joined by inward angling, insertion along the joint edge etc. according to FIG. 3*b*.

Figure 3C:
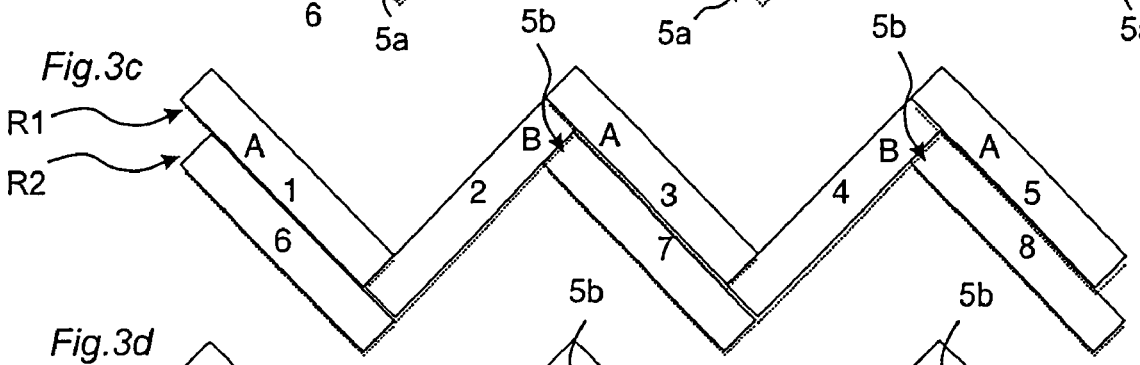
Figure 3D:
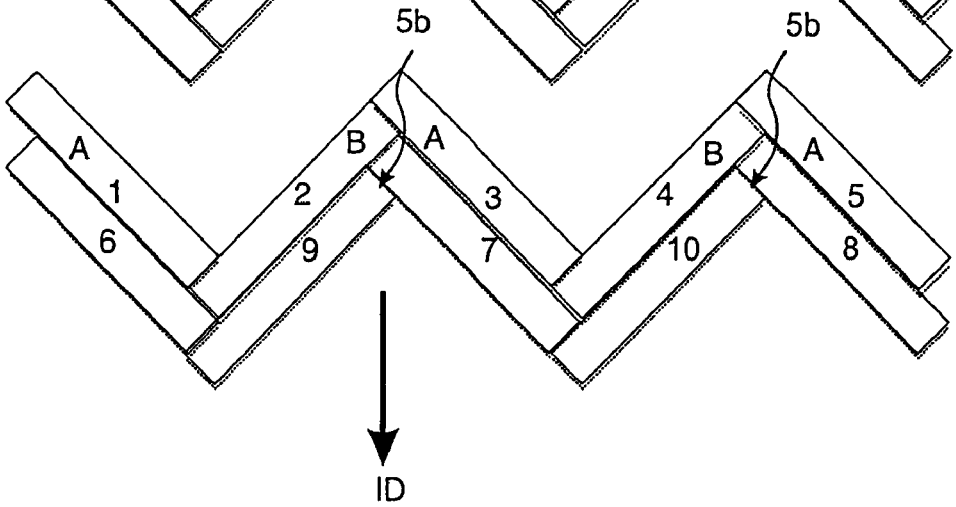

The next row, FIG. 3*c*, is joined by the A boards marked 6, 7 and 8 being joined by inward angling along the long sides. The boards 7 and 8 can be joined in this way since on the short side 5*b* they have no tongue of such a type as prevents downward angling of the short side against the long side. Finally, 3*e* shows how the floorboards 9 and 10 are laid by inward angling. The method of laying is thus characterized in that the entire floor can be laid in a herringbone pattern by inward angling. The laying long side against short side locks the boards alternately vertically and horizontally. With this laying method, all short sides will be locked both horizontally and vertically although they have no vertical locking means in the form of a tongue for instance. Laying is characterized in that two boards of the same type, for instance board A6 and board A7, must be laid before the board B9 can be angled inwards. Within the scope of the invention, the locking system according to FIG. 2*b* can also be provided with a vertical locking means 10' which allows vertical motion with a snap-in effect, as outlined in FIG. 12*b*. However, this is of limited importance to the function of the floor and installation will be more difficult, but such a joint system can provide better strength on the short side when the boards are laid in parallel rows.

Figures 4A, 4B, 4C:
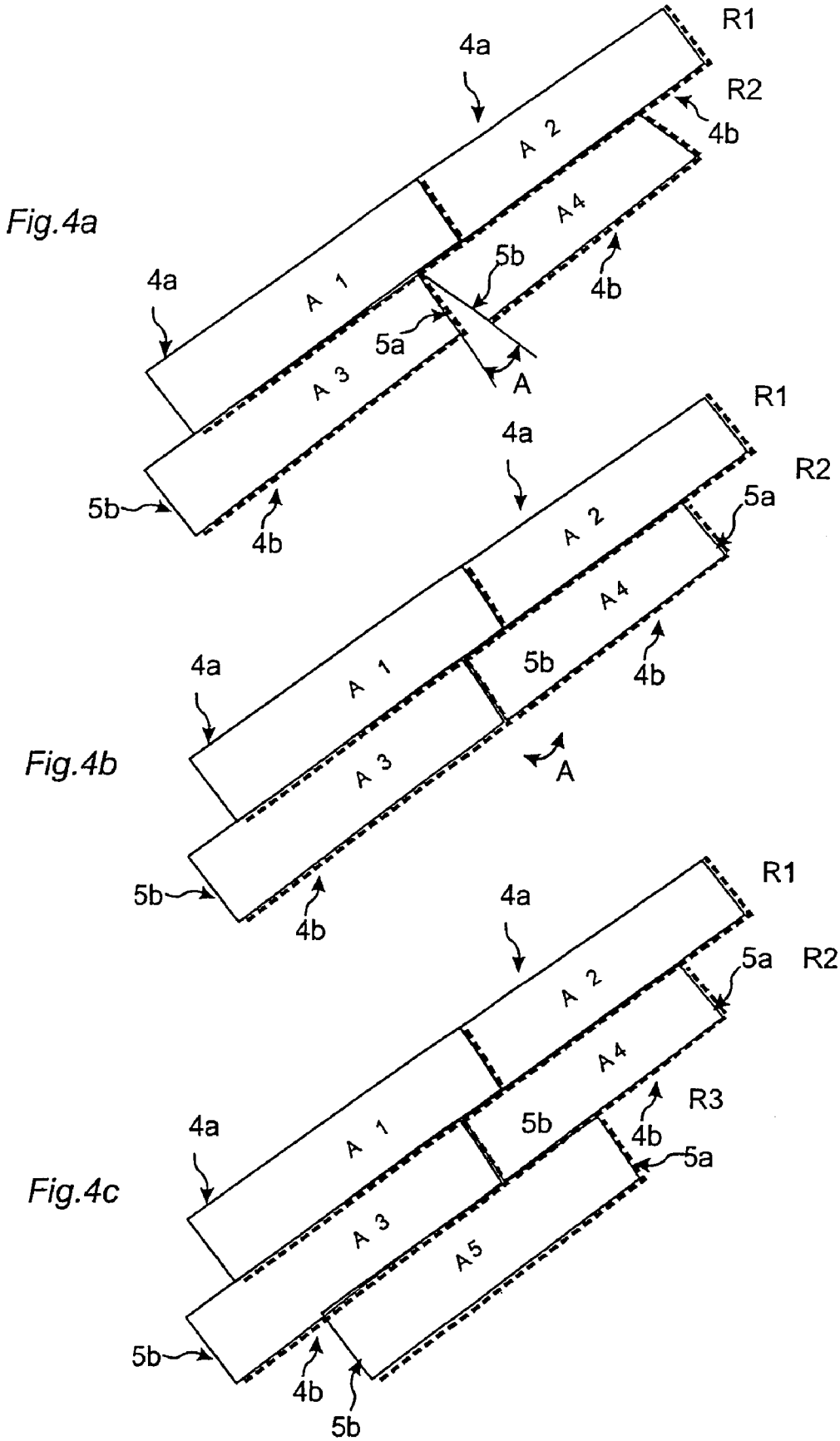
FIGS. 4*a*-4*c* show joining by downward angling.

Floorboards that are adapted to be laid in a herringbone pattern can also, if the joint system is designed in a convenient manner, be joined in parallel rows. This is advantageous since more patterns can be provided with the same type of floorboards and this facilitates production and stock-keeping. FIGS. 4*a* and 4*b* show how a new floorboard A4 in a new row R2 is joined to a previously laid floorboard A2 in a preceding row R1 by an angular motion A along the long sides 4*a* and 4*b*. The short side of the new board A4 with the groove side 5*b* is folded down vertically over the short side of a previously laid board A3 and over its locking side 5*a*. When a subsequently laid board A5 in a subsequent row R3 is joined to the floorboards A3, A4, the long sides in the preceding row R1 and the subsequent row R3 will lock the short sides 5*a* and 5*b* and prevent the groove side 5*b* from being angled upwards. The short sides are then joined both vertically and horizontally. The boards can be detached in reverse order. The tongue groove 9 of the locking side 5*a* is in this laying method not active but is necessary to allow joining to the long side 4*a*. The tongue groove 9*a* thus is not necessary if joining should only take place in parallel rows. A locking angle of, for example, about 60 degrees is usually sufficient to provide great strength in the long sides. Such an angle facilitates inward angling. The corresponding angle on the short side can give insufficient strength, especially in narrow boards with a width of e.g. 60-120 mm. The long sides do not manage to keep the short sides together in the same plane when the locking angle is low. This may result in snapping out or undesirable joint gaps. A high locking angle on the short side gives no drawbacks when the boards are laid by a vertical motion towards the subfloor.

Figure 5A:
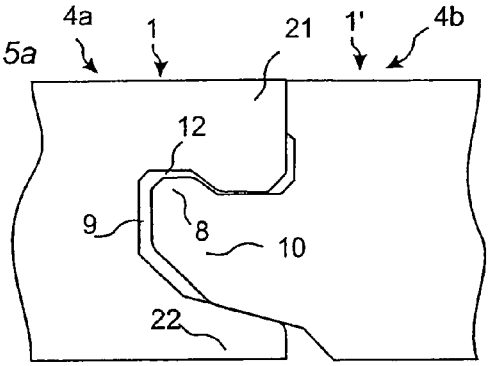
FIGS. 5*a*-5*g* show joining in a herringbone pattern.
Figure 5B:
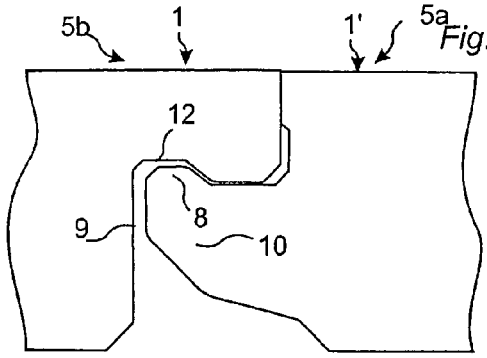
Figure 5C:
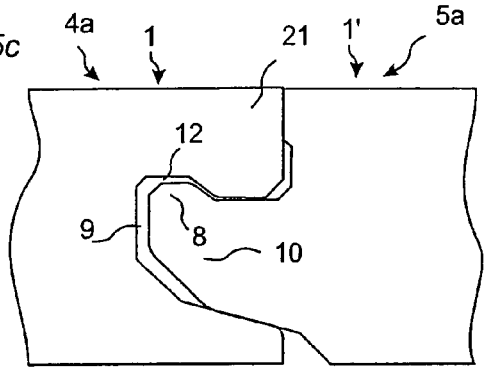
Figure 5D:
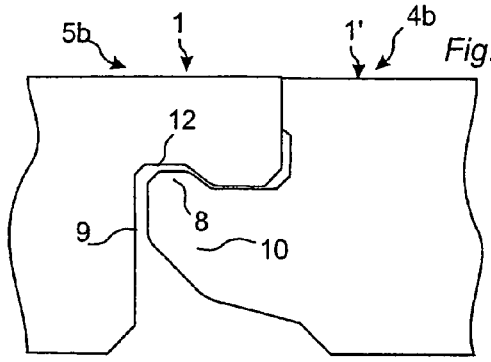
Figure 5E:
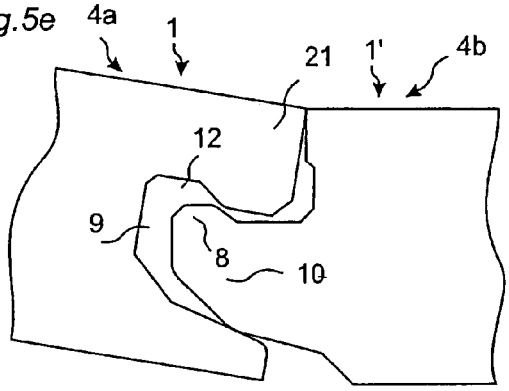
Figure 5F:
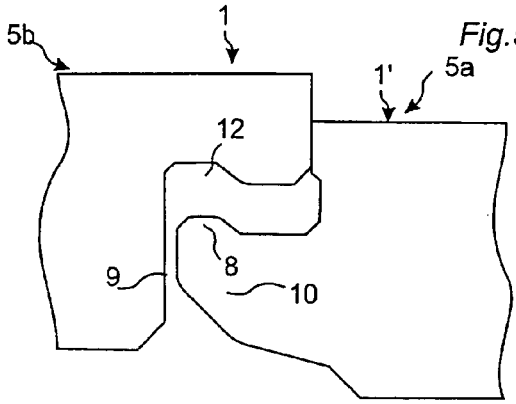
Figure 5G:
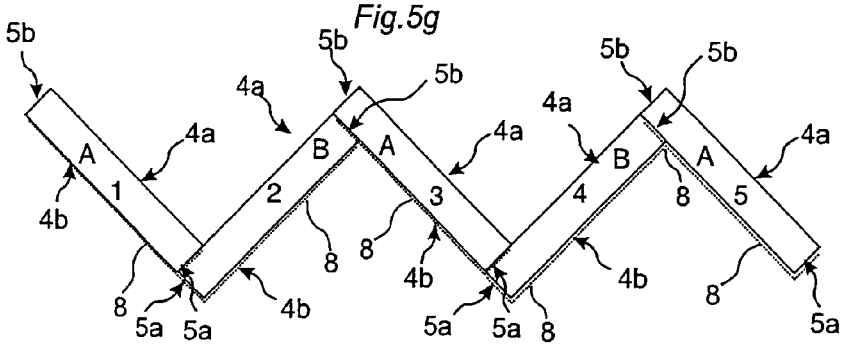

FIG. 5*a* shows a tongue lock in the form of a joint system which consists of a tongue 10 having a locking element 8 in its outer and upper part close to the floor surface in one joint edge of the floorboard 1. The joint system also has a tongue groove 9 with an upper lip 21 and a lower lip 22 as well as an undercut groove 12 in the other joint edge of the floorboard 1'. Such a joint system can be made compact and this reduces the waste of material since the tongue 10 is made by machining the joint edge of the floorboard. The waste of material is important since the floorboards are narrow and short. FIGS. 5*b*-5*g* show how such a joint system can be adjusted so that it can be joined by angling in a herringbone pattern and parallel rows. In this embodiment, the groove side 5*b* of the short side has no lower lip that prevents vertical locking. The long sides can be joined by angling according to FIG. 5*e* and the long sides can also be locked to the short sides by angling and vertical folding according to FIGS. 5*c* and 5*f*. It is obvious that the long sides can be angled with the locking side against the groove side and with the groove side against the locking side. The joint system can also be made of a separate material that is joined to the joint edge. If the floorboards are only intended to be laid in parallel rows, for instance, the long sides can be formed with a tongue lock according to FIG. 5*a* and the short sides with a strip lock according to FIG. 2*a*.

Figure 6A:
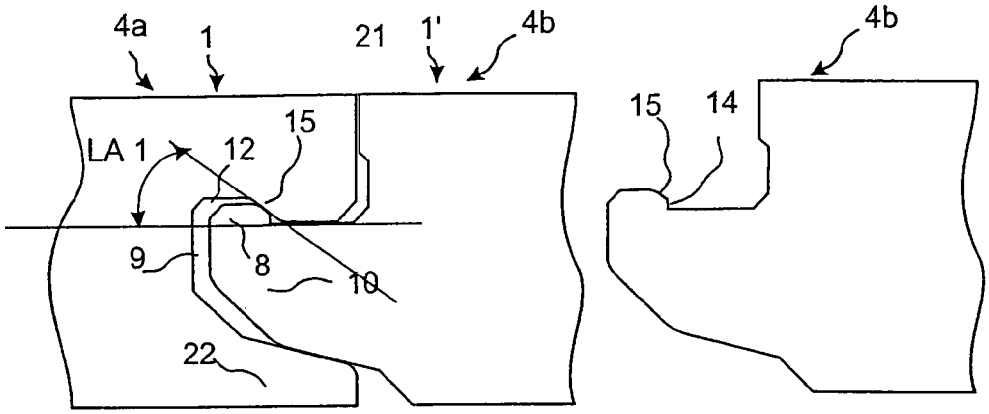
FIGS. 6*a*-6*d* show joint systems according to the invention.
Figure 6B:
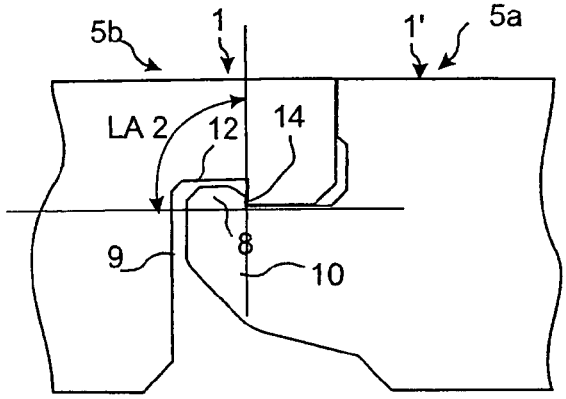
Figure 6C:
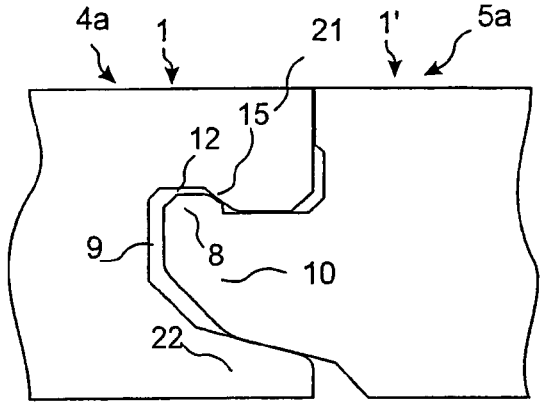
Figure 6D:
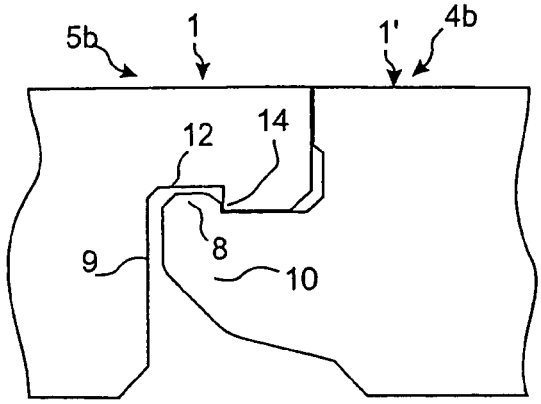
Figure 7A:
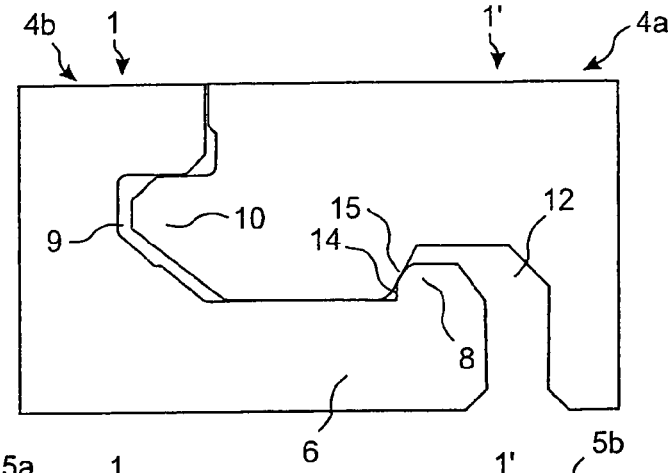
FIGS. 7*a*-7*d* show joint systems according to the invention.
Figure 7B:
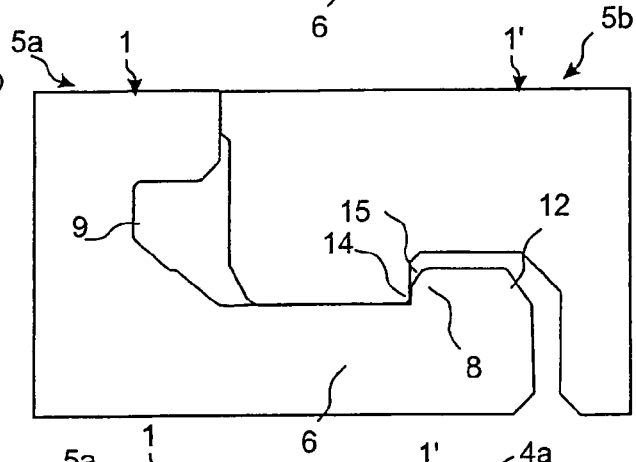
Figure 7C:
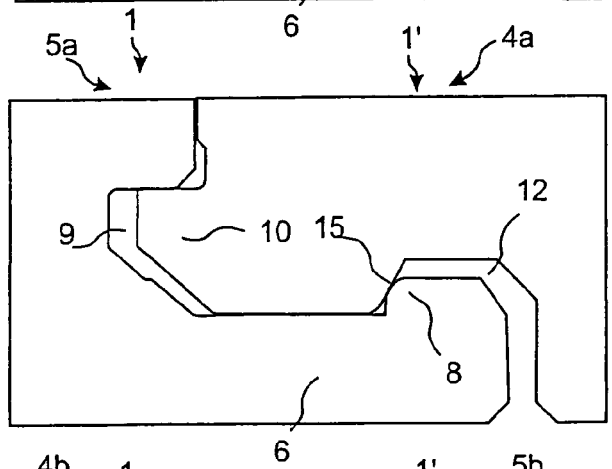
Figure 7D:
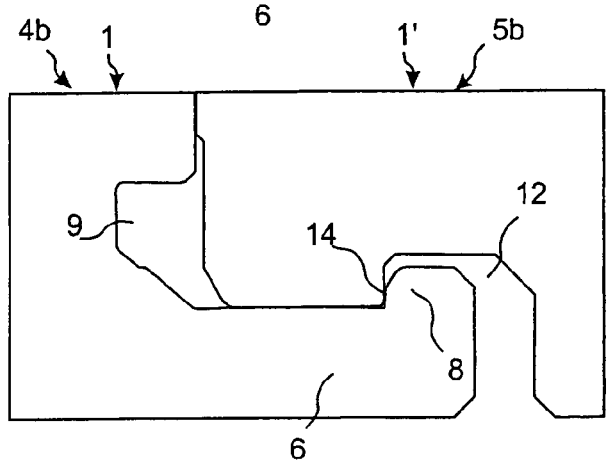

FIGS. 6*a*-6*d* show how the tongue lock can be modified so as to satisfy the two requirements that it should be easy to join by an angular motion long side against long side and long side against short side while at the same time it should have great strength when one short side is joined to another short side by an angular motion towards the floor. The locking element on the long side 4*b* and on the short side 5*a* in FIGS. 6*a* and 6*b* has a locking element with an upper locking surface 15 close to the surface of the floorboard, which has a lower locking angle LA 1 than a lower locking surface 14 with the locking angle LA 2. The groove side 4*a* of the long side is adapted to cooperate with the upper locking surface 15 which has the lower locking angle LA 1, and the groove side 5*b* of the short side is adapted to cooperate with the lower locking surface 14 which has the higher locking angle LA 2. FIGS. 6*c* and 6*d* show joining long side against short side. The low locking angle on the long side is an advantage in machining since the undercut groove 12 can then be made using large rotary tools. Higher locking angles can be made, for example, by scraping with a stationary tool against a joint edge in motion. The high locking angle in the groove 12 can easily be made since the lower lip 22 is missing.

FIGS. 7*a*-7*d* show how the strip lock, with a protruding strip 6 which supports a locking element 8, can be modified in the same way as the tongue lock so that a locking angle with locking short side 5*a* to short side 5*b* can take place with a higher locking angle than in the case when the long side is locked to the long side or the short side. The locking element on both long side and short side has an upper locking surface 15 which has a lower locking angle than a lower locking surface 14. The locking element 8 of the short side 5*a* has a longer extent horizontally than the short side. This improves the strength of the short side while at the same time the waste of material increases only marginally. All locking elements 8 which are preferred can in this manner be made greater on the short side, and the locking groove of the long side can be adjusted so that it can be joined to the locking element 8 of the short side.

Figure 8A:
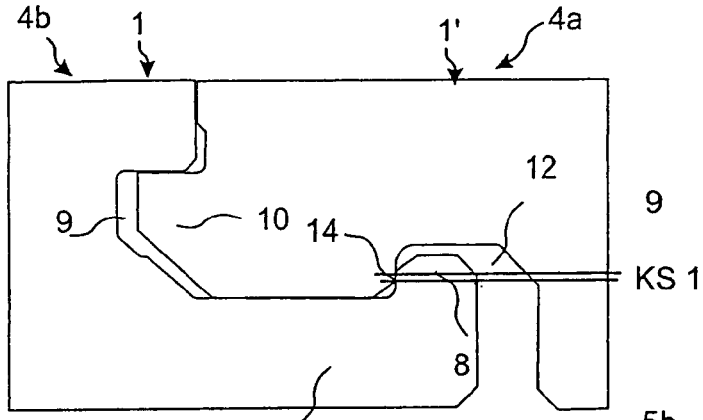
FIGS. 8*a*-8*d* show joint systems according to the invention.
Figure 8B:
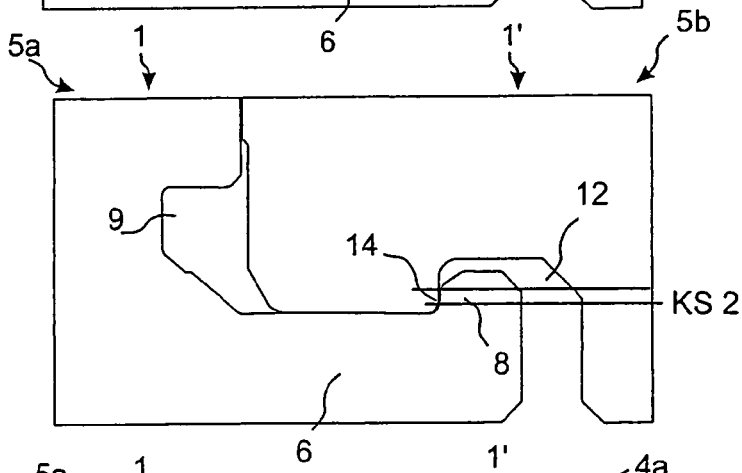
Figure 8C:
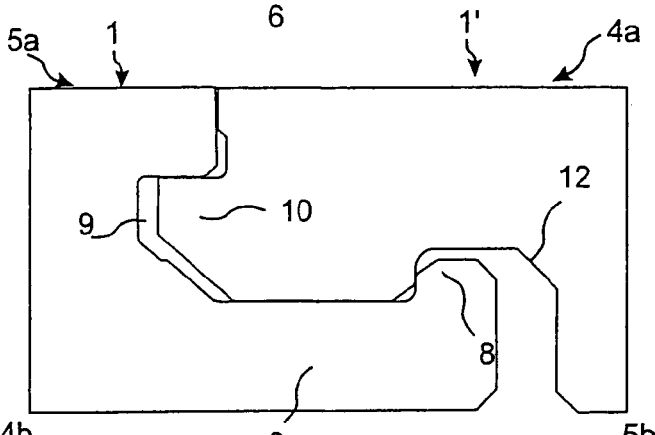
Figure 8D:
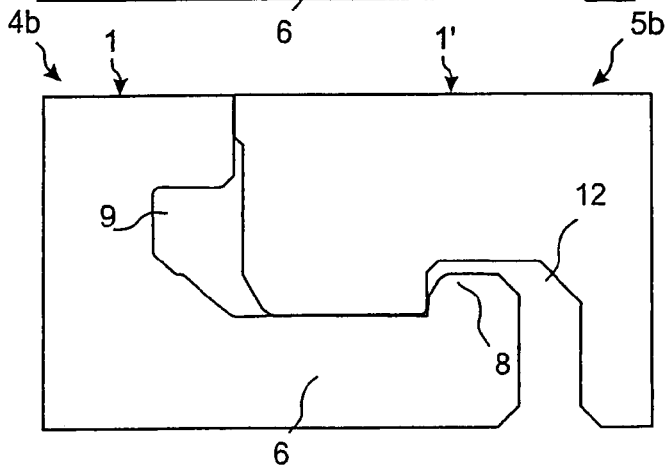

FIGS. 8*a*-8*b* show a strip lock with a locking element on long sides and short sides which has a locking surface 14 which is essentially perpendicular to the horizontal plane. The contact surface KS 1 between the locking element 8 and the locking groove 12 is on the long side greater than the contact surface KS 2 on the short side. As a non-limiting example, it may be mentioned that the contact surface KS 1 of the long side can give sufficient strength with a vertical extent which is only 0.1-0.3 mm. Material compression and strip bending allow inward angling and upward angling in spite of the high locking angle. Such a joint system on the long side can be combined with a joint system on the short side which has a high locking angle and a contact surface KS 2 of, for instance, 0.5-1.0 mm. A small play on the long side of for instance 0.01-0.10 mm, which arises between the locking surfaces when the boards are pressed together horizontally, additionally facilitates upward angling and makes manufacture easy. Such a play causes no visible joint gaps between the upper joint edges. The joint system can be made with locking angles exceeding 90 degrees. If this is done merely on the short sides, the boards can easily be released from each other by being pulled out parallel to the joint edge after the long sides have been, for instance, released by upward angling.

Figure 9A:
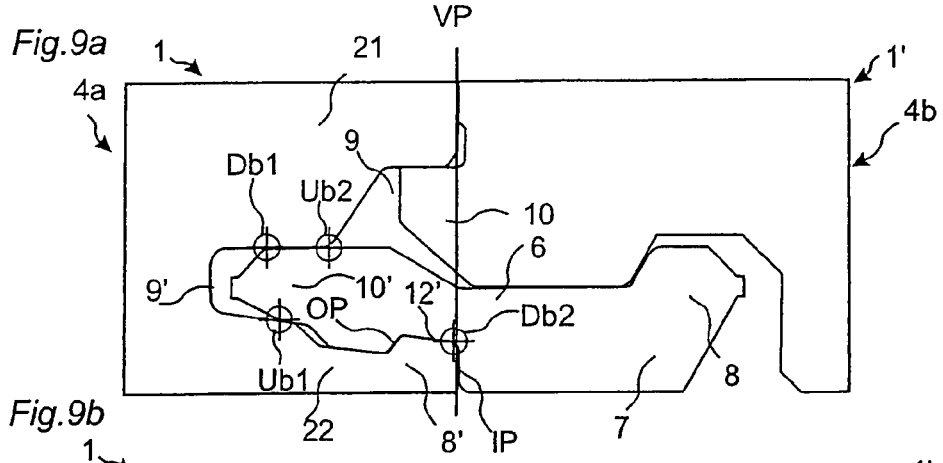
FIGS. 9*a*-9*e* show joint systems according to the invention.

FIGS. 9*a*-9*d* show a strip lock which consists of a separate material, for example a fiberboard-based material such as HDF or the like. Such a joint system can be less expensive than one that is made in one piece with the floorboard. Moreover, strip materials can be used, that have other and better properties than the floorboard and that are specially adjusted to the function of the joint system. The strip 6 in FIG. 9*a* is factory-attached to the floorboard 1 mechanically by snapping-in in an upwardly angled position. This is shown in FIG. 9*e*. FIG. 9*a* shows that the strip and the joint edge portion of the floorboard have cooperating parts which with great accuracy lock the strip horizontally and vertically and prevent a vertical motion of the outer part 7 of the strip upwardly to the floor surface and downwardly to the rear side. The strip is positioned and locked to the floorboard horizontally and vertically by the tongue 10' of the strip cooperating with the tongue groove 9' of the floorboard, and by the locking element 8' of the floorboard cooperating the locking groove 12' of the strip. The portions Db1 and Db2 prevent downward bending of the outer part 7 of the strip in case of tension load, and the portions Ub1 and Ub2 prevent upward bending of the outer part 7 so that the strip does not come loose during handling before laying. The portions IP and UP position the strip in its inner and outer position relative to the vertical plane VP.

Figure 9B:
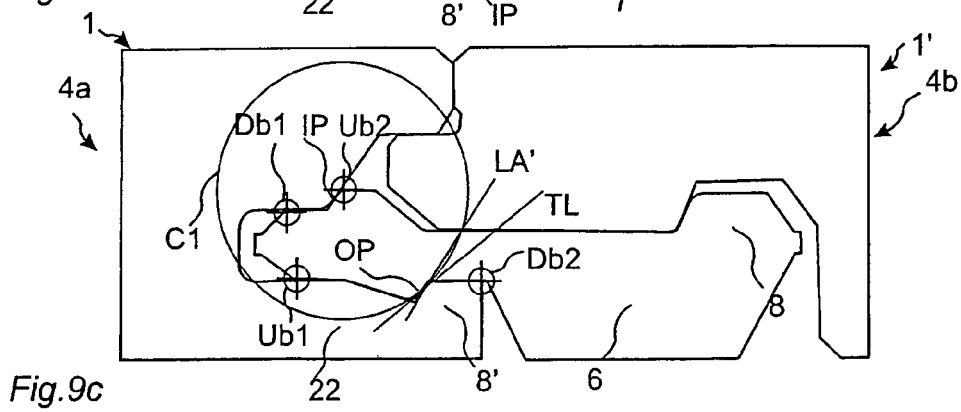
Figure 9C:
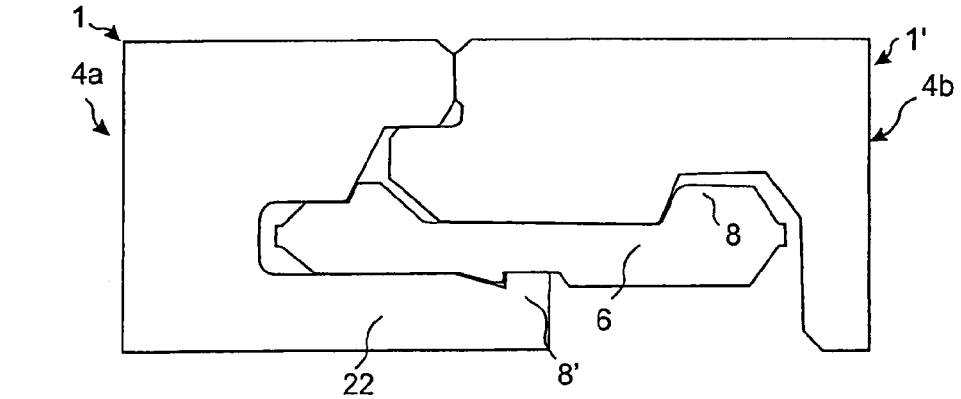
Figure 9D:
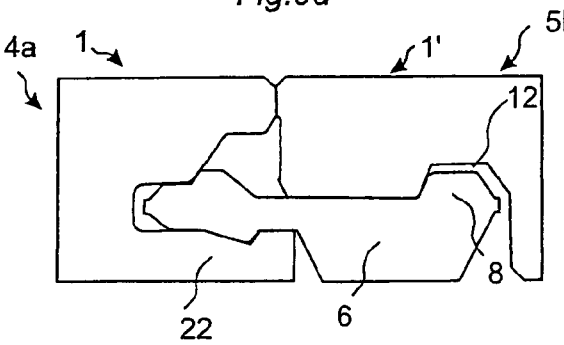
Figure 9E:
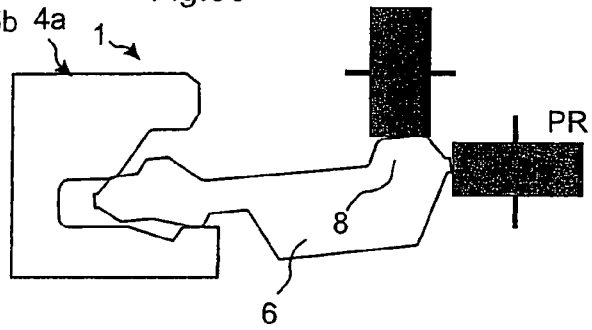
Figure 10A:
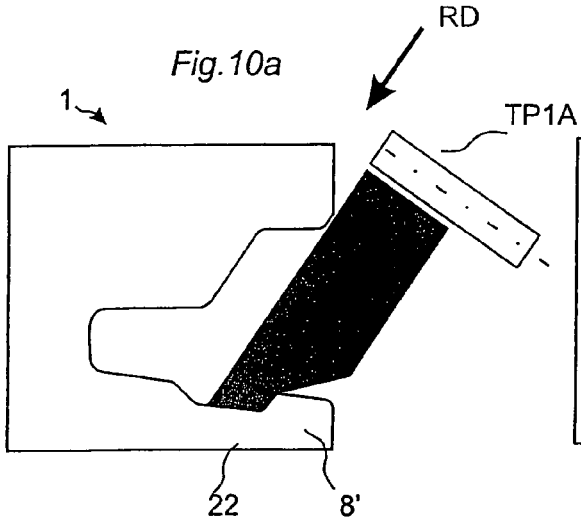
FIGS. 10*a*-10*d* show machining of joint systems.
Figure 10B:
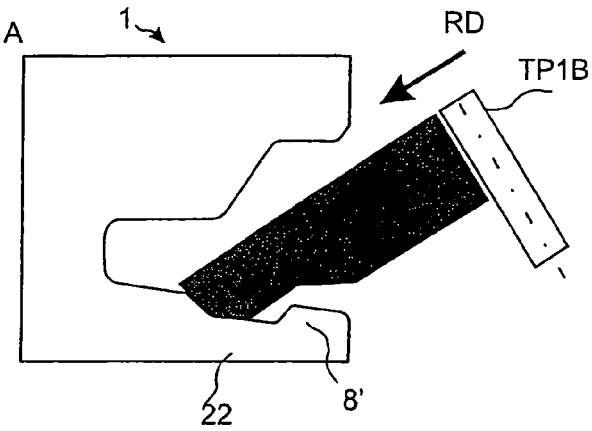
Figure 10C:
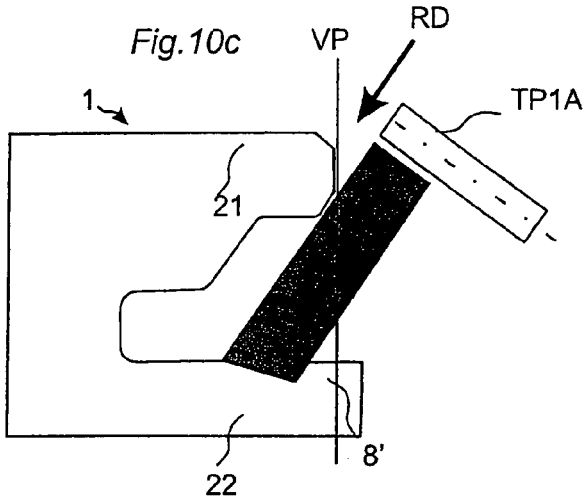
Figure 10D:
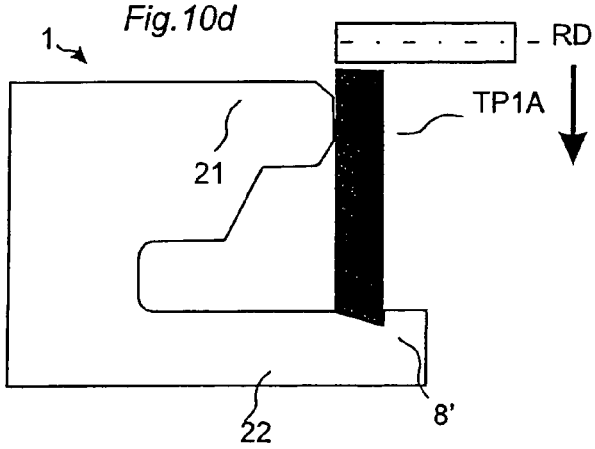

FIG. 9*b* shows an embodiment which is convenient for e.g., wooden floors. Upward bending is prevented by the portions Ub1 and Ub2 and also by the fact that the locking angle LA is higher than the tangent to the circular arc C1 with is center in the point of rotation Ub2. FIG. 9*c* shows an embodiment in which the strip 6 is located in a plane which is closer to the surface than the rear side of the floor. The strip 6 can then be made of a thinner board material than in the embodiments according to FIGS. 9*a* and 9*b*. FIG. 9*d* shows how the short side can be formed. All these embodiments can be combined with the locking angles and joint geometries that have been described above. A number of combinations are feasible. The long side may have, for example, a joint system with a separate strip, and a short side may be formed in one piece according to, for example, some of the previously preferred embodiments.

FIGS. 10*a*-*d* show how the lower lip 22 can be formed by large rotary tools. The joint system according to FIGS. 10*a* and 10*b* requires two tools TP1A and TP1B which machine the joint edge portions at two different angles. RD indicates the direction of rotation. A corresponding part in the joint systems according to FIGS. 10*c* and 10*d* can be made using one tool only. In these two embodiments, the lower lip 22 projects from the vertical plane VP.

FIGS. 11*a*-11*j* show embodiments in which the strip 6 is made of a metal sheet, preferably aluminum. The design has been chosen so that the strip 6 can be formed by merely bending. This can be done with great accuracy and at low cost. Sufficient strength can be achieved with 0.4-0.6 mm metal sheet thickness. All embodiments allow inner (IP) and outer (OP) positioning and they also counteract the angular motion of the strip 6 upwards (Ub1, Ub2) and downwards (Db1 and Db2). The joint edge portions can also be manufactured rationally by large rotary tools.

Figure 12A:
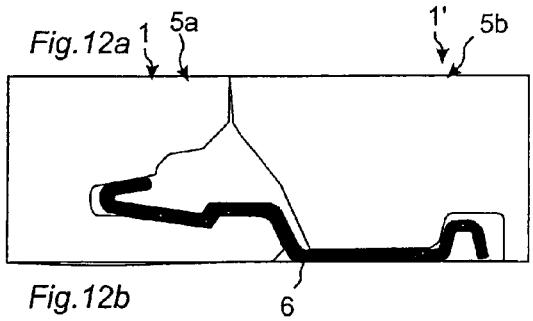
FIGS. 12*a*-12*j* show joint systems according to the invention.
Figure 12B:
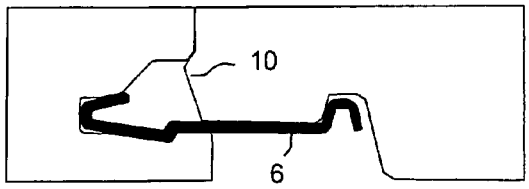
Figure 12C:
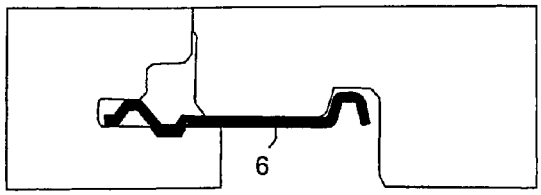
Figure 12D:
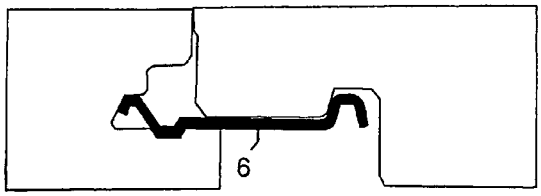
Figure 12E:
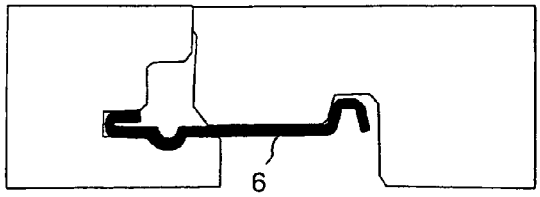
Figure 12F:
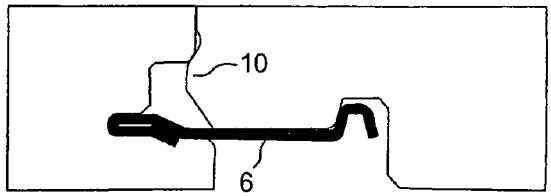
Figure 12G:
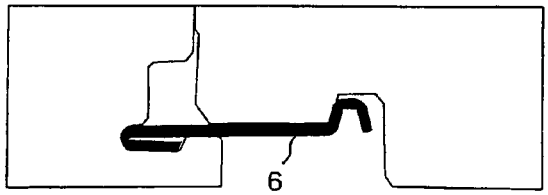
Figure 12H:
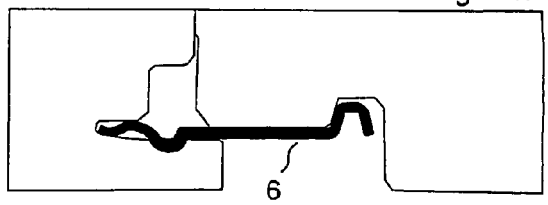
Figure 12I:
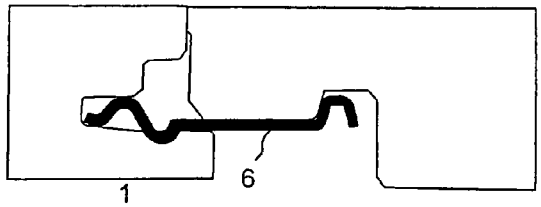
Figure 12J:
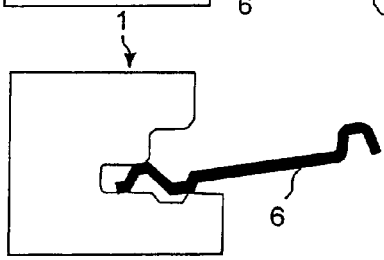

FIGS. 12*a*-12*i* show short sides. FIGS. 12*b* and 12*f* show that the joint system can also be made with vertical locking in the form of a small tongue 10. This allows locking with vertical snapping-in. FIG. 12*j* shows how the strip is factory-attached by snapping-in in an upwardly angled position. It is obvious that separate strips can be supplied so that they are attached to the floorboard in connection with installation. This can take place manually or by means of tools, see FIG. 9*e*, which are formed so that the floorboard and the strip, for instance, are moved past pressing rollers PR which by a combination of snapping and angling attach the strip 6. A strip of, for example, aluminum sheet which is formed by merely bending and which is attached to the joint edge of the floorboard by snapping-in is less expensive and easier to manufacture than other known alternatives.

The floorboards can on one side, for instance the long side, have one type of joint system formed according to a preferred embodiment and made in one piece, of fiberboard-based material or of metal. The other side may have another type. It is also obvious that many variants can be provided by changing angles, radii and dimensions. Strips can also be made by extrusion of metals, plastics and various combinations of materials. The joint systems can also be used to join other products, for instance wall panels and ceilings, but also components for furniture. Mechanical joint systems that are used in floors can also be used for mounting, for instance, kitchen cupboards on walls.

Figure 13A:
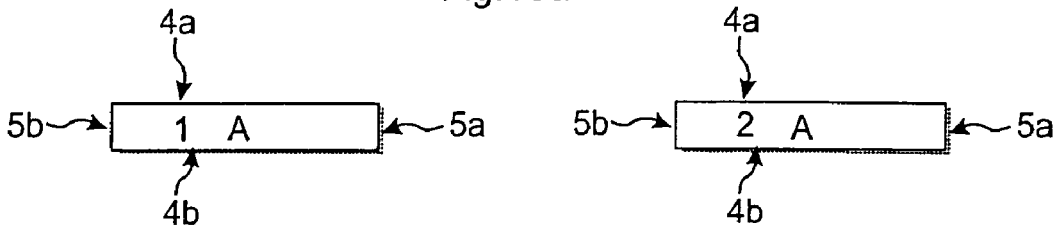
FIGS. 13*a*-13*f* show joining in parallel rows.
Figure 13B:
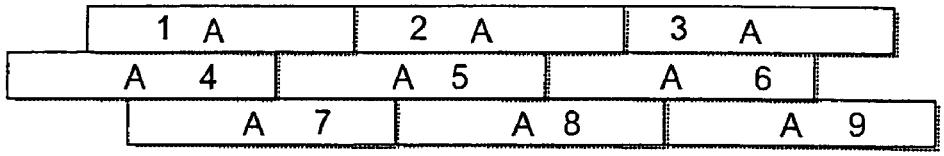

FIGS. 13*a*-*f* show laying methods for joining of floors. FIG. 13*a* shows floorboards of a type A having a locking side 5*a* and a groove side 5*b*. Since the groove side is to be folded down on the locking side, it is convenient to install the floor so that installation of all rows is made from the same side. As a rule, the floor-layer must then move many times. This may take a considerable time when large surfaces are installed. The order of installation is A1, A2 . . . A9.

Figure 13C:
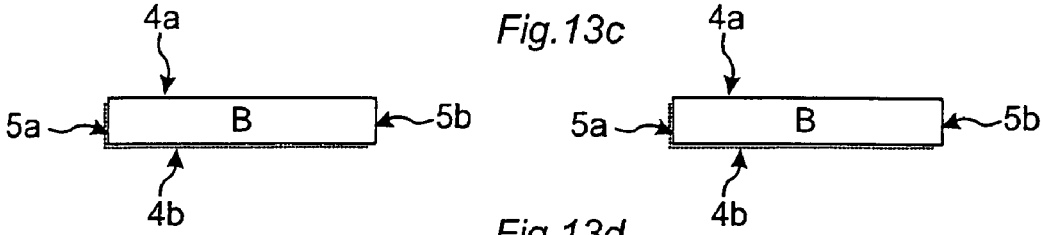
Figure 13D:
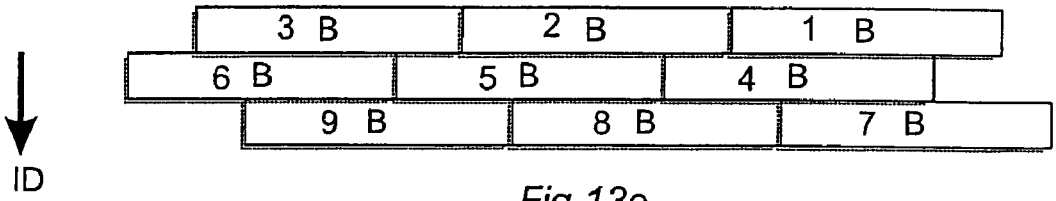

FIGS. 13*c* and *d* show that B boards should be installed from the opposite direction since their locking systems on the short side are mirror-inverted relative to the A boards.

Figure 13E:
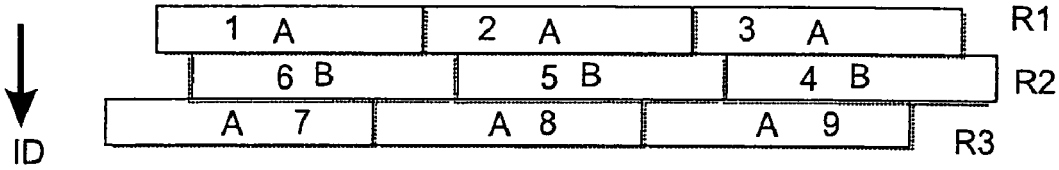

FIG. 13*e* shows that installation can take place alternately from left to right if A and B boards are used. This reduces the time of laying.

Figure 13F:
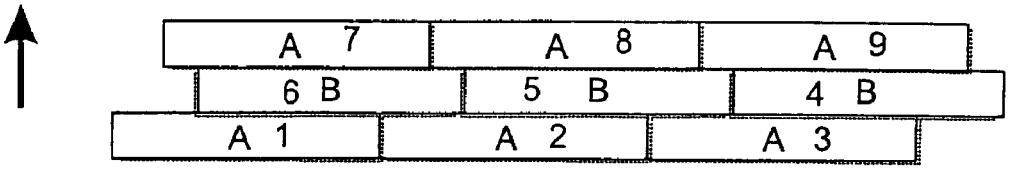
Figure 14A:
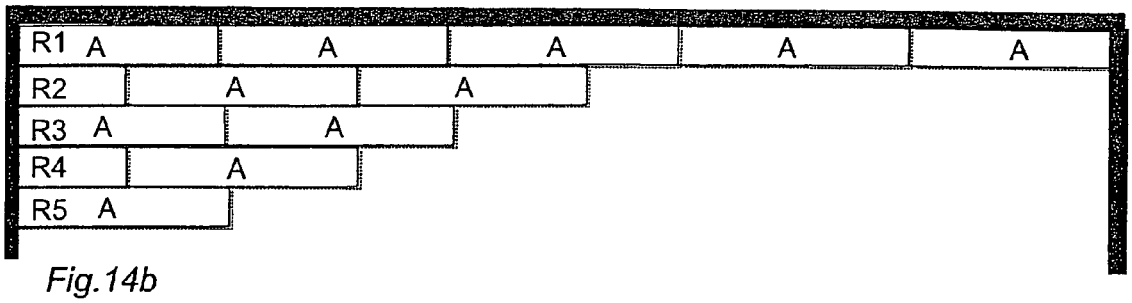
FIGS. 14*a*-14*d* show joining in parallel rows.
Figure 14B:
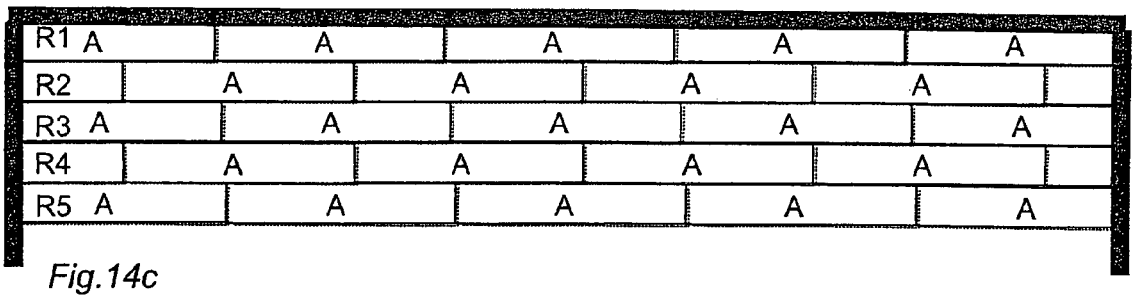
Figure 14C:
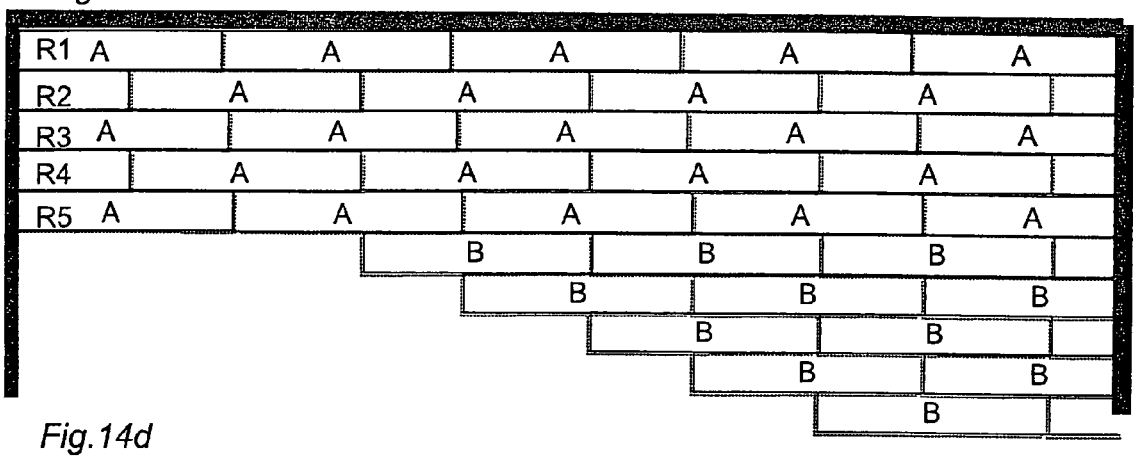
Figure 14D:
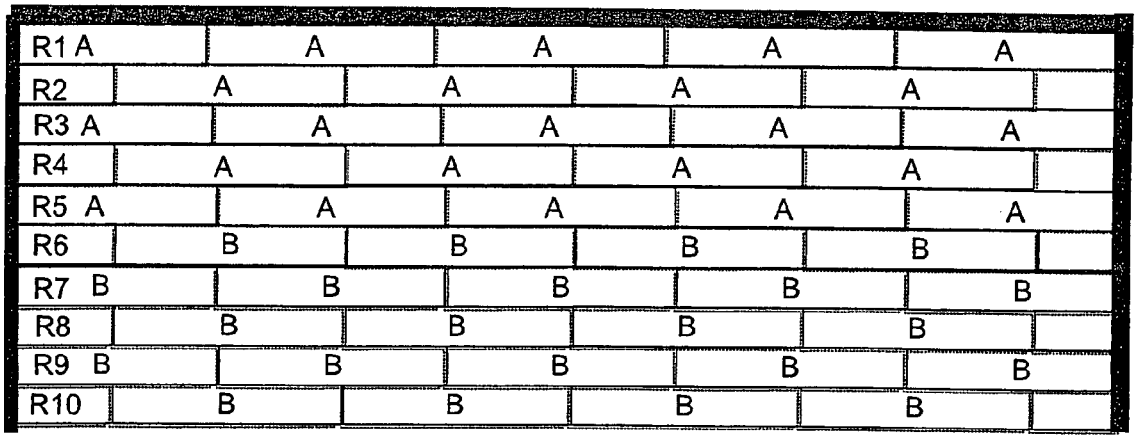

FIG. 13*f* shows that installation can also be made backwards in the direction of installation ID.

FIGS. 14*a*-*d* show a rational installation in parallel rows using A and B boards with mirror-inverted joint systems. According to FIG. 14*a*, for instance the rows R1-R5 with A boards are first installed. Then a movement takes place and the remaining A boards are installed according to FIG. 14*b*. In the next step, B boards are installed, after which a movement takes place and the remaining B boards can be installed. Installation of these ten rows can thus take place with only two movements. The method in this example is characterized by a first B board in a new row R6 being joined to the last laid A board in a preceding row R5. Thus, the present invention comprises also a floor which consists of two types of boards A and B with mirror-inverted joint systems which are joined in parallel rows.

Installation according to the above-preferred method can also be made by angling and snapping-in and with only one type of floorboards if they have short sides that can be joined in both directions parallel to the long sides.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A system for making a flooring which comprises rectangular floorboards which are mechanically lockable, in which system the individual floorboards along their long sides have pairs of opposing connectors for locking together similar floorboards both vertically and horizontally and along their short sides have pairs of opposing connectors which lock the floorboards horizontally, the connectors of the floorboards are adapted so as to allow locking-together of the long sides by angling along an upper joint edge and of the short sides by vertical folding, the system comprises two different types of floorboards, the connectors of one of the types of floorboards along one pair of opposite edge portions being arranged in a mirror-inverted manner relative to the corresponding connectors along the same pair of opposite edge portions of the other of the type of floorboards, a first short side being lockable to a long side vertically and horizontally, and a second short side being lockable to a long side horizontally by vertical folding, and horizontal connectors on the short sides having cooperating locking surfaces which are formed different from the cooperating locking surfaces of the horizontal connectors of the long sides wherein part of a horizontal connector comprises a separate locking strip of metal, the locking strip is mechanically fixed to the floorboard by means of a joint which is operable by snapping-in and/or at least inward angling, the locking strip is designed for connecting the floorboard with another floorboard of the system by at least inward angling, the floorboard comprising a laterally open strip groove in one joint edge portion and the locking strip comprising a strip tongue, the locking strip is mechanically fixed to the floorboard by way of said strip tongue being mechanically fixed within the strip groove only forming a joint which is operable by snapping in and/or inward angling, and the locking strip extends horizontally beyond the outer parts of the laterally open strip groove, and that the separate strip is a bent metal sheet.

2. A floorboard as claimed in claim 1, wherein the metal sheet is of aluminium.

3. A floorboard as claimed in claim 1, wherein the thickness of the metal sheet is 0.4-0.6 mm.

4. A floorboard as claimed in claim 1, wherein the strip groove and a tongue groove which, for connection in a vertical direction perpendicular to a principal plane of the floorboard, is designed to receive a tongue arranged on said another floorboard, at least one surface of said tongue groove consisting of said locking strip.

5. A floorboard as claimed in claim 4, wherein a locking surface arranged on said strip groove and adapted to cooperate with a locking surface arranged on said locking strip.

6. A floorboard as claimed in claim 5, wherein said locking surface arranged on the strip groove is arranged on a lower lip which defines said strip groove, and that said locking surface arranged on the locking strip is arranged on a lower surface of said locking strip.

7. A floorboard as claimed in claim 6, wherein the locking strip forms an extension of said lower lip.

8. A floorboard as claimed in claim 6, wherein said lower lip projects from said vertical plane.

9. A floorboard comprising connecting means which are integrated with the floorboard and adapted to connect the floorboard with an essentially identical floorboard, wherein upper joint edges of said floorboard and said essentially identical floorboard in the connected state define a vertical plane, said connecting means being designed to connect said floorboard with said essentially identical floorboard in at least a horizontal direction perpendicular to said vertical plane, said connecting means comprising a locking strip which projects from said vertical plane and carries a locking element which is designed to cooperate, in said connected state, with a downward open locking groove of said essentially identical floorboard, said locking strip consisting of a separate part which is arranged on the floorboard, said locking strip in said horizontal and vertical directions being mechanically fixed to the floorboard, said locking strip is mechanically fixed to the floorboard by means of a joint which is operable by snapping-in and/or at least inward angling, said locking strip is designed for connecting the floorboard with the essentially identical floorboard by at least inward angling, the floorboard comprising a laterally open strip groove in one joint edge portion and the locking strip comprising a strip tongue, said locking strip is mechanically fixed to the floorboard by way of said strip tongue being mechanically fixed within the strip groove only forming a joint which is operable by snapping in and/or inward angling, said locking strip extends horizontally beyond the outer parts of the laterally open strip groove, and that the locking strip is a bent metal sheet.

10. A floorboard as claimed in claim 9, wherein the metal sheet is of aluminium.

11. A floorboard as claimed in claim 9, wherein the thickness of the metal sheet is 0.4-0.6 mm.

12. A floorboard as claimed in claim 9, wherein the strip groove and a tongue groove which, for connection in a vertical direction perpendicular to a principal plane of the floorboard, is designed to receive a tongue arranged on said essentially identical floorboard, at least one surface of said tongue groove consisting of said locking strip.

13. A floorboard as claimed in claim 12, wherein a locking surface arranged on said strip groove and adapted to cooperate with a locking surface arranged on said locking strip.

14. A floorboard as claimed in claim 13, wherein said locking surface arranged on the strip groove is arranged on a lower lip which defines said strip groove, and that said locking surface arranged on the locking strip is arranged on a lower surface of said locking strip.

15. A floorboard as claimed in claim 14, wherein the locking strip forms an extension of said lower lip.

16. A floorboard as claimed in claim 15, wherein said lower lip projects from said vertical plane.

17. A floorboard as claimed in claim 14, wherein said lower lip projects from said vertical plane.

* * * * *